US008790138B2

(12) United States Patent
Wang et al.

(10) Patent No.: US 8,790,138 B2
(45) Date of Patent: Jul. 29, 2014

(54) ELECTRICAL CONNECTOR SOCKET CAPABLE OF TRANSMITTING DIFFERENT SIGNALS

(75) Inventors: Ching-Shun Wang, New Taipei (TW); Chia-Ho Chang, New Taipei (TW); Yuan-Bin Tang, New Taipei (TW)

(73) Assignee: Advanced Connection Technology, Inc., New Taipei (TW)

( * ) Notice: Subject to any disclaimer, the term of this patent is extended or adjusted under 35 U.S.C. 154(b) by 194 days.

(21) Appl. No.: 13/607,748

(22) Filed: Sep. 9, 2012

(65) Prior Publication Data

US 2013/0323984 A1 Dec. 5, 2013

(30) Foreign Application Priority Data

Jun. 1, 2012 (TW) ..... 101210652 A

(51) Int. Cl.
*H01R 24/00* (2011.01)

(52) U.S. Cl.
USPC ..... 439/660; 439/607.4

(58) Field of Classification Search
USPC ..... 439/660, 607.4, 607.35, 607.54

IPC ..... H01R 23/7073,23/6873, 23/02, 13/658, H01R 13/65802

See application file for complete search history.

(56) References Cited

U.S. PATENT DOCUMENTS

| | | | | |
|---|---|---|---|---|
| 7,862,378 | B1 * | 1/2011 | Wan et al. | 439/607.35 |
| 8,202,120 | B2 * | 6/2012 | Ko | 439/607.35 |
| 8,323,057 | B2 * | 12/2012 | Ho | 439/660 |
| 8,641,454 | B2 * | 2/2014 | Chen et al. | 439/660 |

* cited by examiner

*Primary Examiner* — Hien Vu

(74) *Attorney, Agent, or Firm* — Muncy, Geissler, Olds & Lowe, P.C.

(57) ABSTRACT

An electrical connector socket includes an insulating base, a first group of signal terminals, a second group of signal terminals, and a third group of signal terminals. The first group of signal terminals includes first terminals for transmitting a first signal. The second group of signal terminals includes second terminals and third terminals, and the second terminals and the third terminals are used for transmitting a second signal. The third group of signal terminals includes fourth terminals, the second terminals are located between the first group of signal terminals and the third group of signal terminals, the fourth terminals are used for transmitting a third signal, and the first group of signal terminals and the third group of signal terminals are used for transmitting a fourth signal.

7 Claims, 8 Drawing Sheets

ELECTRICAL CONNECTOR SOCKET CAPABLE OF TRANSMITTING DIFFERENT SIGNALS

CROSS-REFERENCES TO RELATED APPLICATIONS

This non-provisional application claims priority under 35 U.S.C. §119(a) on Patent Application No. 101210652 filed in Taiwan, R.O.C. on 2012 Jun. 1, the entire contents of which are hereby incorporated by reference.

BACKGROUND OF THE INVENTION

1. Technical Field

The present invention relates to an electrical connector, and more particularly to an electrical connector socket capable of transmitting a plurality of different signals.

2. Related Art

Currently, electronic apparatuses are widely used. With electronic devices becoming increasingly light, thin, short, and small, the volume occupied by electrical connectors on the electronic devices must be reduced accordingly. Particularly when multiple electrical connectors conforming to different electronic signal transmission specifications need to be installed to provide plugging of different plug connectors, since the installation of each electrical connector necessarily occupy a certain volume, and the electrical connectors must be spaced from one another by intervals, the intervals cause a waste of space.

If an electronic device providing digital video entertainment needs a socket electrical connector conforming to a high-definition multimedia interface (HDMI) specification and a socket connector conforming to a universal serial bus (USB) specification, and also needs an earphone socket and a microphone socket, considerable space on the electronic device is wasted to install the socket connectors.

Consequently, there is still a need of integrating multiple electrical connectors such as external serial advanced technology attachment (ESATA) connectors, HDMI connectors, display-ports or USB connectors to save the occupied space while taking into consideration the configuration of each group of signal terminals and false plugging of different plug interfaces, which is a problem to be solved by relevant manufacturers involved in the industry.

SUMMARY

Accordingly, the present invention provides an electrical connector socket, including an insulating base, a first group of signal terminals, a second group of signal terminals, and a third group of signal terminals. The first group of signal terminals includes a plurality of first terminals for transmitting a first signal, and each of the first terminals has one end located on a first surface of a first tongue portion of the insulating base. The second group of signal terminals includes a plurality of second terminals and a plurality of third terminals, each of the second terminals has one end located on a first surface of a second tongue portion of the insulating base, each of the third terminals has one end located on a second surface of the second tongue portion, and the second terminals and the third terminals are used for transmitting a second signal. The third group of signal terminals includes a plurality of fourth terminals, each of the fourth terminals has one end located on the first surface of the second tongue portion, the second terminals are located between the first group of signal terminals and the third group of signal terminals, the fourth terminals are used for transmitting a third signal, and the first group of signal terminals and the third group of signal terminals are used for transmitting a fourth signal.

In the present invention, a tongue plate of the insulating base includes a first tongue portion and a second tongue portion connected to the first tongue portion, so as to provide setting of a first group of signal terminals, a second group of signal terminals, and a third group of signal terminals, thereby providing an effect of transmitting a plurality of different signals. Each of the second terminals and the fourth terminals has one end located on a first surface of the second tongue portion of the insulating base, and the ends are arranged in front and rear rows. Additionally, the second terminals are located between the first group of signal terminals and the third group of signal terminals, and a transmitting body of the fourth terminal is located on the insulating base and between the second terminal and the third terminal, so as to provide an impedance matching effect among the terminals.

The detailed features and advantages of the present invention are described below in great detail through the following embodiments, and the content of the detailed description is sufficient for persons skilled in the art to understand the technical content of the present invention and to implement the present invention there accordingly. Based upon the content of the specification, the claims, and the drawings, persons skilled in the art can easily understand the relevant objectives and advantages of the present invention.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
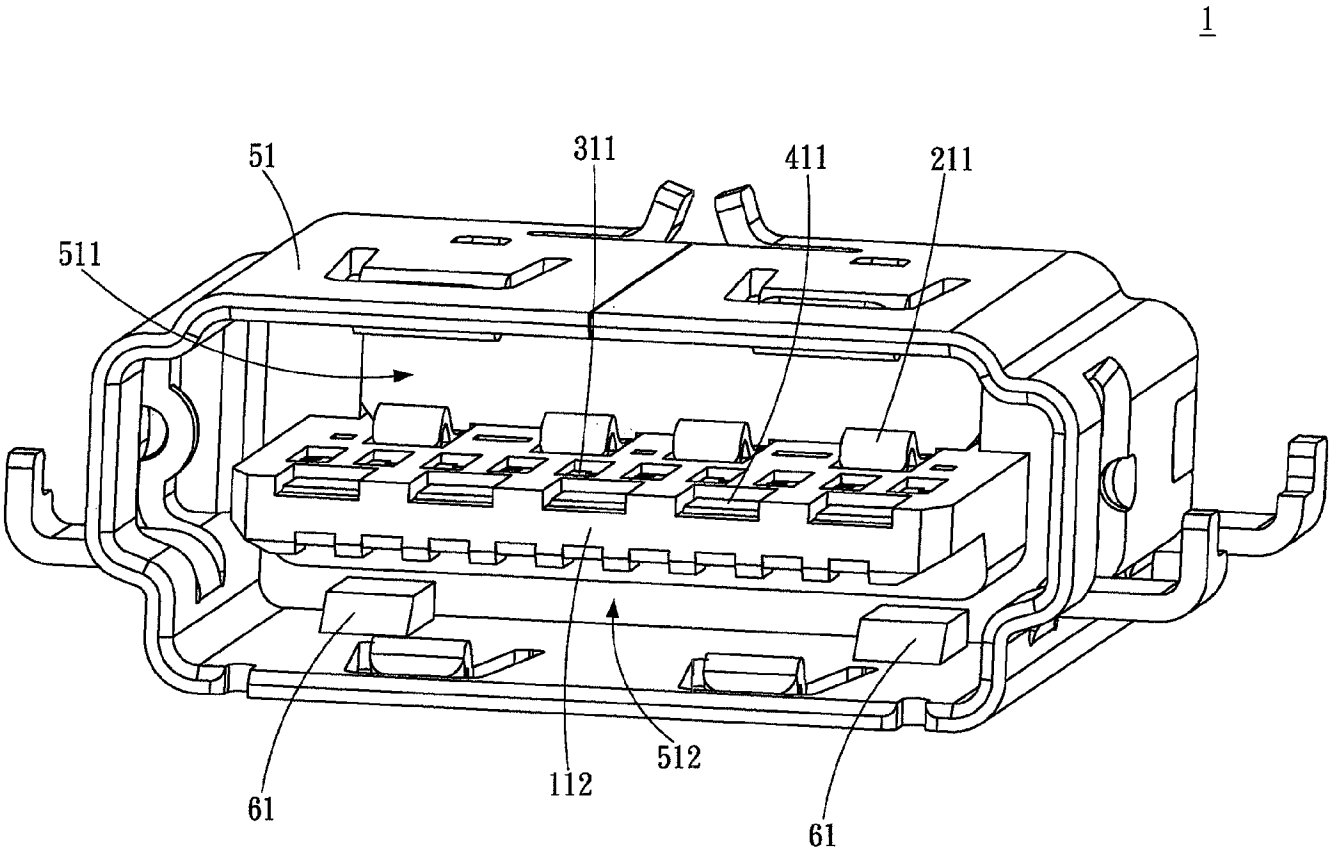
FIG. 1 is a schematic three-dimensional view of a first embodiment of the present invention.
Figure 2:
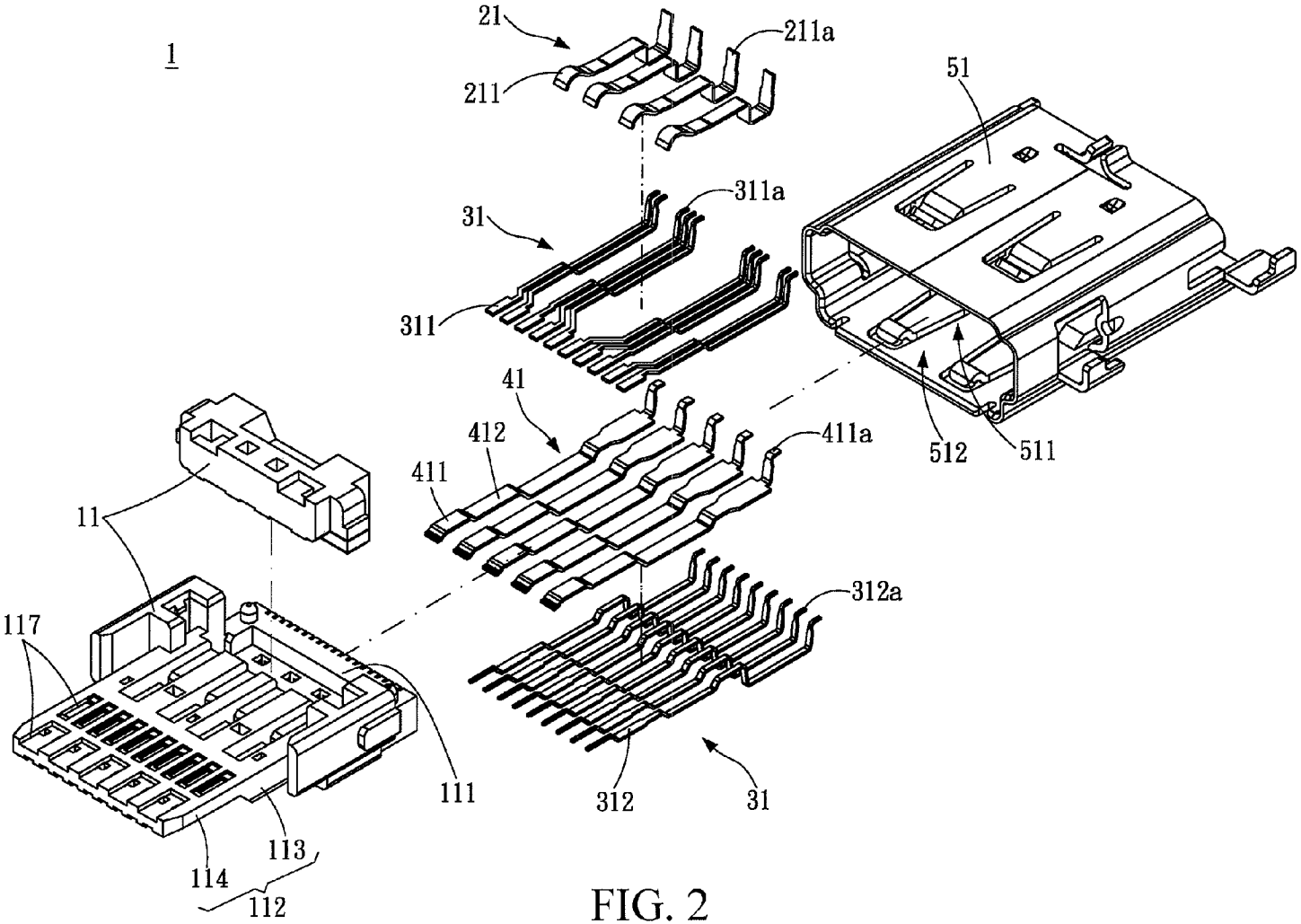
FIG. 2 is a schematic exploded view of the first embodiment of the present invention.
Figure 3:
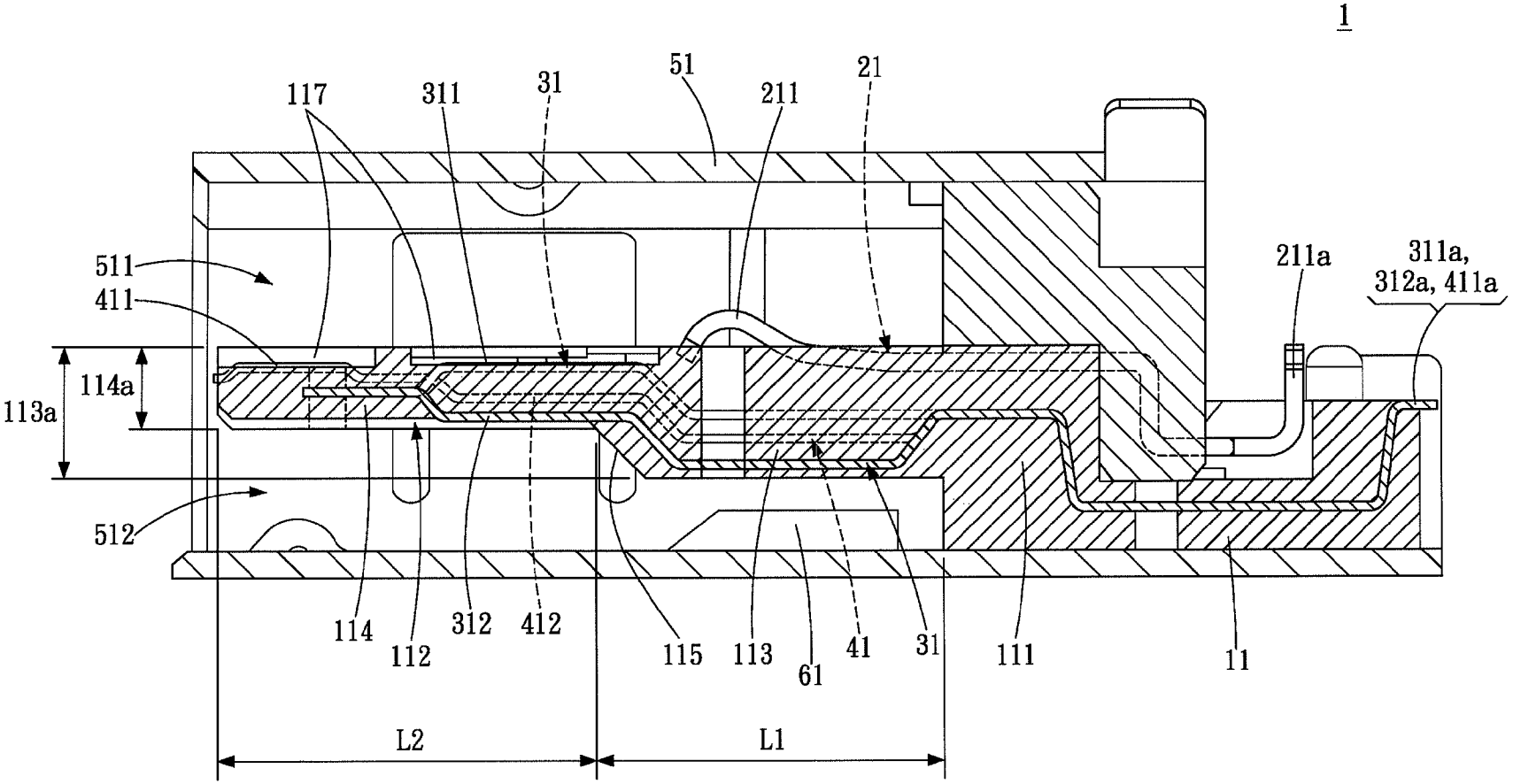
FIG. 3 is a schematic cross-sectional view of the first embodiment of the present invention.

Please refer to FIGS. 1, 2, and 3, in which a first embodiment of the present invention is shown. FIG. 1 is a schematic outside view, FIG. 2 is a schematic exploded view, and FIG. 3 is a schematic cross-sectional view.

Figure 7:
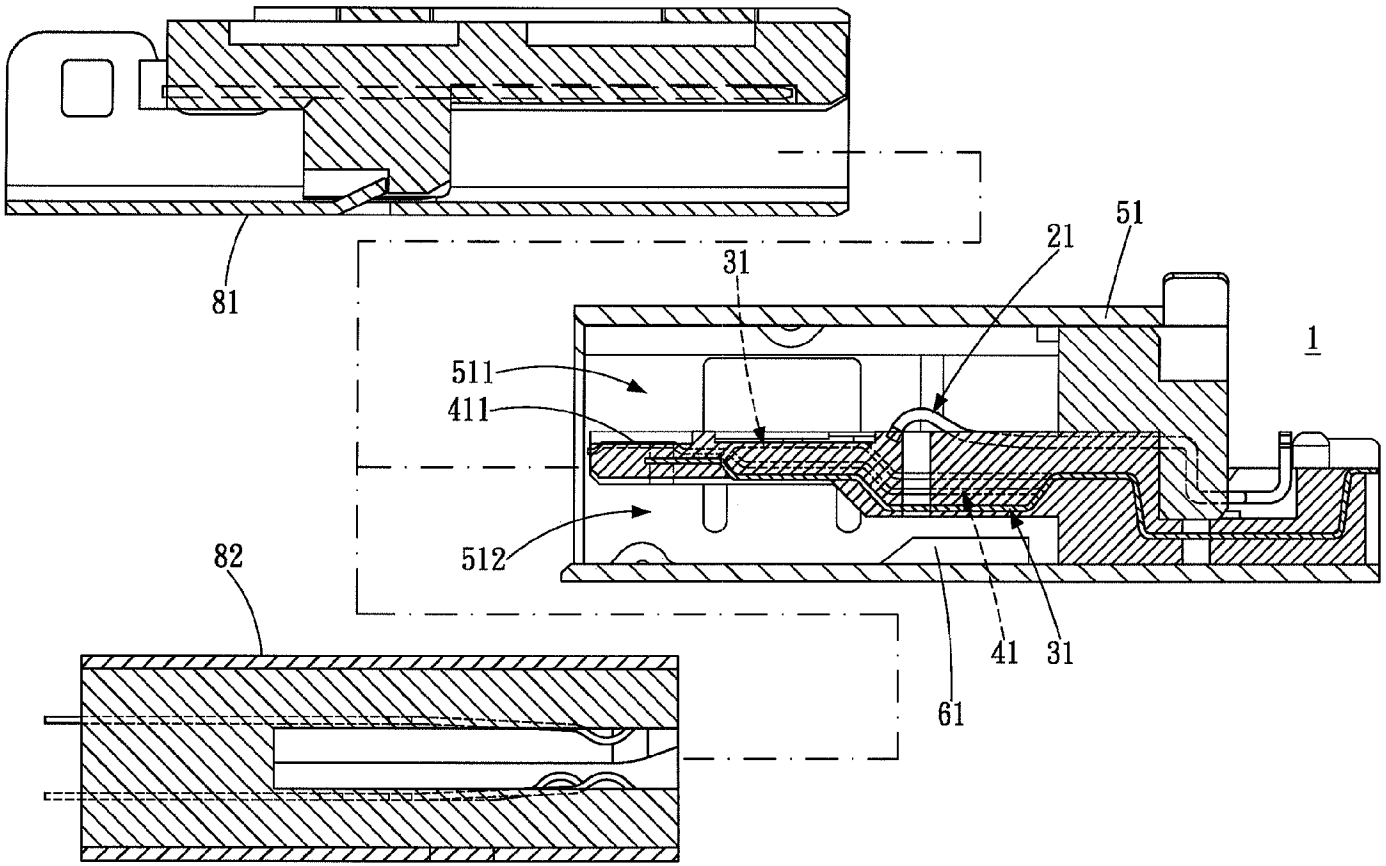
FIG. 7 is a schematic cross-sectional view of the present invention and plugs.

In the drawings of the first embodiment, an electrical connector socket 1 for plugging of at least two plugs (as shown in FIG. 7), with different specifications, is shown. In this embodiment, a first plug 81 for transmitting a USB2.0 signal and a second plug 82 for transmitting an HDMI signal are taken as an example for illustration; however, the transmission specifications of the first plug 81 and the second plug 82 are only exemplary, but the present invention is not limited thereto. The electrical connector socket 1 includes an insulating base 11, a first group of signal terminals 21, a second group of signal terminals 31, and a third group of signal terminals 41.

Figure 6:
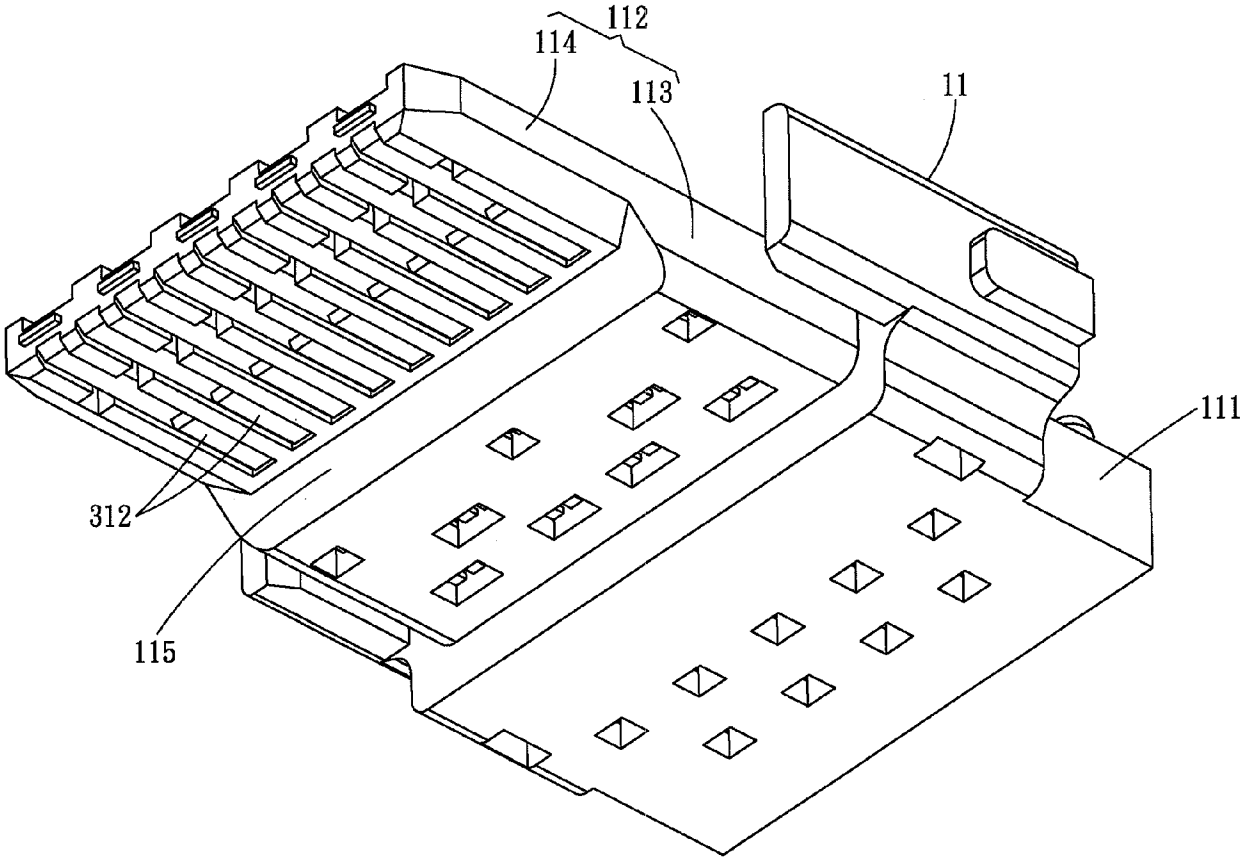
FIG. 6 is a schematic partial outside view of another side of the present invention.

The insulating base 11 is made of a plastic material, and includes a main body 111 and a tongue plate 112 which are integrally formed. The tongue plate 112 includes a first tongue portion 113 and a second tongue portion 114 being connected to each other and having different thicknesses. The first tongue portion 113 has a first thickness 113*a* and is connected to the main body 111, and the second tongue portion 114 has a second thickness 114*a* being different from the first thickness 113*a*. Here, the second thickness 114*a* of the second tongue portion 114 is smaller than the first thickness 113*a*, so that a stop surface 115 is formed between the first tongue portion 113 and the second tongue portion 114 (as shown in FIG. 6). Further, the first tongue portion 113 of the tongue plate 112 has a first length L1, the second tongue portion 114 of the tongue plate 112 has a second length L2, the first length L1 of the first tongue portion 113 is from the main body 111 to the second tongue portion 114, and the second length L2 of the second tongue portion 114 is greater than the first length L1 (as shown in FIG. 3).

The first group of signal terminals 21 is made of a metal plate. The first group of signal terminals 21 is located on the main body 111 of the insulating base 11, and includes a plurality of first terminals 211 for transmitting a first signal (that is, a USB2.0 signal), where each of the first terminals 211 has one end located on a first surface of the first tongue portion 113.

The second group of signal terminals 31 is made of a metal plate. The second group of signal terminals 31 is located on the main body 111 of the insulating base 11, and includes a plurality of second terminals 311 and a plurality of third terminals 312. Each of the second terminals 311 has one end located on a first surface of the second tongue portion 114 (that is, coplanar with the first surface of the first tongue portion 113). Each of the third terminals 312 has one end located on a second surface of the second tongue portion 114 (that is, opposite the first surface of the second tongue portion 114). The second terminals 311 and the third terminals 312 are used for transmitting a second signal (that is, an HDMI signal).

In some embodiments, the second signal transmitted by the second terminals 311 and the third terminals 312 may also be a Display-Port, Mini HDMI, or Mini Display-Port signal.

The third group of signal terminals 41 is made of a metal plate. The third group of signal terminals 41 is located on the main body 111 of the insulating base 11. Here, the second terminals 311 of the second group of signal terminals 31 are located between the first group of signal terminals 21 and the third group of signal terminals 41. The third group of signal terminals 41 includes a plurality of fourth terminals 411. Each of the fourth terminals 411 has one end located on the first surface of the second tongue portion 114, that is, one end of the second terminal 311 exists between one end of the fourth terminal 411 and one end of the first terminal 211, and one end of the third terminal 312 exists on another side of the one end of the second terminal 311 (as shown in a cross-section of FIG. 3). The fourth terminals 411 are used for transmitting a third signal (that is, an ESATA signal), and the first group of signal terminals 21 and the third group of signal terminals 41 are used for transmitting a fourth signal (that is, a USB3.0 signal). Here, the fourth terminal 411 includes a transmitting body 412, located on the insulating base 11 and between the second terminal 311 and the third terminal 312, so as to provide an impedance matching effect among the terminals.

Here, the number of the first group of signal terminals 21 described above conforms to a first specification, and therefore the first group of signal terminals 21 is used to transmit a group of first signals (for example, USB2.0 signals), of the first specification, so as to provide plugging of the first plug 81 (as shown in FIG. 7), of the first specification. The number of the second group of signal terminals 31 and the third group of signal terminals 41 conforms to a second specification, and therefore the second group of signal terminals 31 and the third group of signal terminals 41 are used to transmit a group of second signals (for example, HDMI signals), of the second specification, so as to provide plugging of the second plug 82 (as shown in FIG. 7), of the second specification. The number of the third group of signal terminals 41 conforms to a third specification, and therefore the third group of signal terminals 41 is used to transmit a group of third signals (for example, ESATA signals), of the third specification, so as to provide plugging of a third plug (not shown) of the third specification. The fourth terminals 411 and the first terminals 211 are used to transmit fourth signals (for example, USB3.0 signals), of a fourth specification, so as to provide plugging of a fourth plug (not shown), of the fourth specification. However, according to the content disclosed in the present invention, persons skilled in the art may alter the number of terminals according to actual demands, so as to transmit multiple groups of signals.

Figure 4:
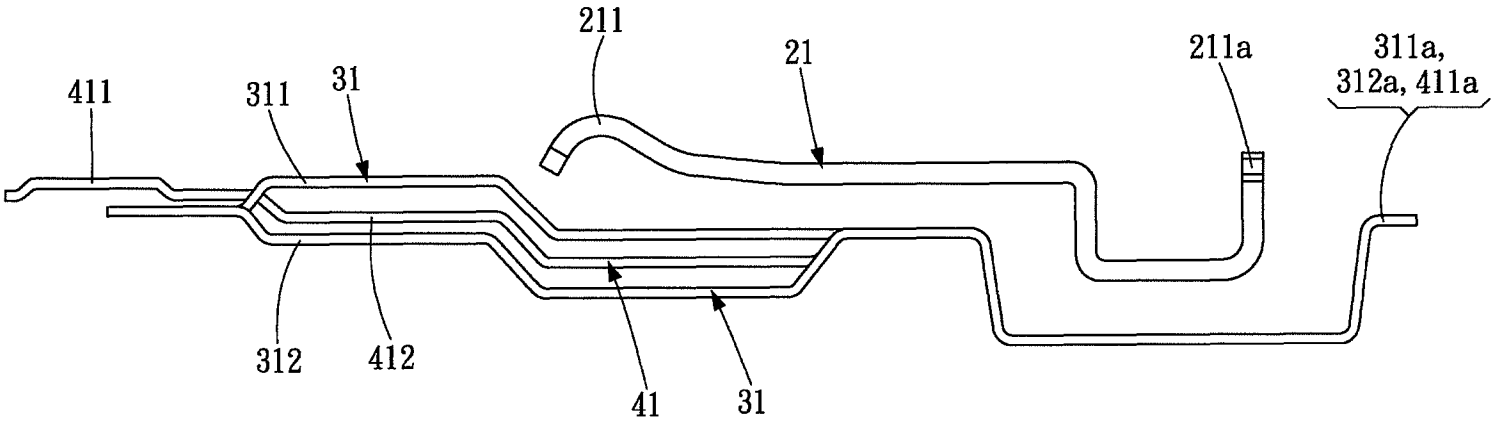
FIG. 4 is a schematic view of a plurality of groups of signal terminals according to the present invention.

In some embodiments, one end of each of the first terminals 211 of the first group of signal terminals 21 includes a first pin 211*a*, one end of each of the second terminals 311 of the second group of signal terminals 31 includes a second pin 311*a*, one end of each of the third terminals 312 of the second group of signal terminals 31 includes a third pin 312*a*, one end of each of the fourth terminals 411 of the third group of signal terminals 41 includes a fourth pin 411*a*, and the pins are exposed out of the insulating base 11. In this embodiment, the first pins 211 a and the second pins 311 a, third pins 312*a*, and fourth pins 411*a* are arranged in a front-rear manner (as shown in FIG. 4). Here, the arrangement manner of the first pins 211 a, the second pins 311 a, the third pins 312*a*, and the fourth pins 411*a* is only exemplary, but the present invention is not limited thereto in practice. Further, the first pins 211*a*, the second pins 311*a*, the third pins 312*a*, and the fourth pins 411*a* may be soldered on a circuit board in a dual in-line package (DIP) manner or a surface mounted tech (SMT) manner.

Figure 5:
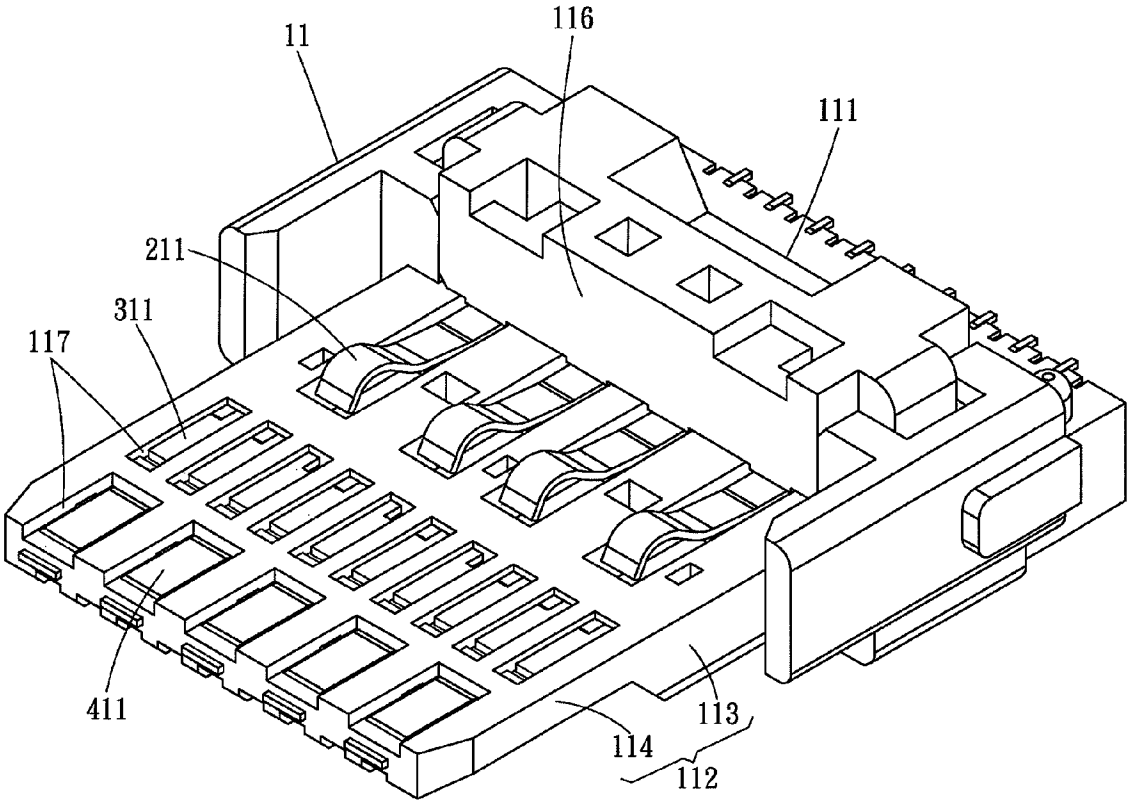
FIG. 5 is a schematic partial outside view of the first embodiment of the present invention.

In some embodiments, referring to FIGS. 5 and 6, in order to clearly show the configuration of the insulating base 11 and the terminals, an outer frame is not shown in FIGS. 5 and 6, the second tongue portion 114 includes a plurality of separators 117 having a cross-section being in a form of a depressed groove, located on a surface of the second tongue portion 114, facing a first frame port 511, and providing setting of one end of the second terminal 311 and one end of the fourth terminal 411. Here, in a case where the first tongue portion 113 and a surface of the second tongue portion 114 form a plane, one end of the second terminal 311 and one end of the fourth terminal 411 are located in the groove and spaced by a distance from a surface of the second tongue portion 114. In this manner, when a plug is plugged in the socket 1, a plurality of terminals of the plug is connected to one end of the second terminal 311 or one end of the fourth terminal 411 of the socket 1. With the step formed by the groove, one end of the second terminal 311 or one end of the fourth terminal 411 is prevented from being too near to the terminals of the plug, so as to prevent the signal from being interfered by static electricity.

In some embodiments, the electrical connector socket 1 further includes an outer frame 51 being a hollow frame body and wrapping the insulating base 11. The outer frame 51 includes a first frame port 511 and a second frame port 512 connected to the first frame port 511, where the frame ports as a whole approximately exhibit an inverted "T" shape. Here, the first frame port 511 conforms to the first specification preferably being USB2.0, and the second frame port 512 conforms to the second specification preferably being HDMI. Further, the size of the first frame port 511 of the first specification is smaller than that of the second frame port 512 of the second specification. Here, the first tongue portion 113 and one surface of the second tongue portion 114 form a plane facing the first frame port 511, but in practice, the plane may also face the second frame port 512. Further, in some embodiments, the electrical connector socket 1 further includes a plurality of limit blocks 61 (as shown in FIG. 1), located on an inner side of the outer frame 51, and for limiting a plug in a position inside the outer frame 51.

Here, the previous description concerning the first frame port 511 and the second frame port 512 conforming to the plugging specification of the plug is only exemplary, the present invention is not limited thereto.

Figure 8:
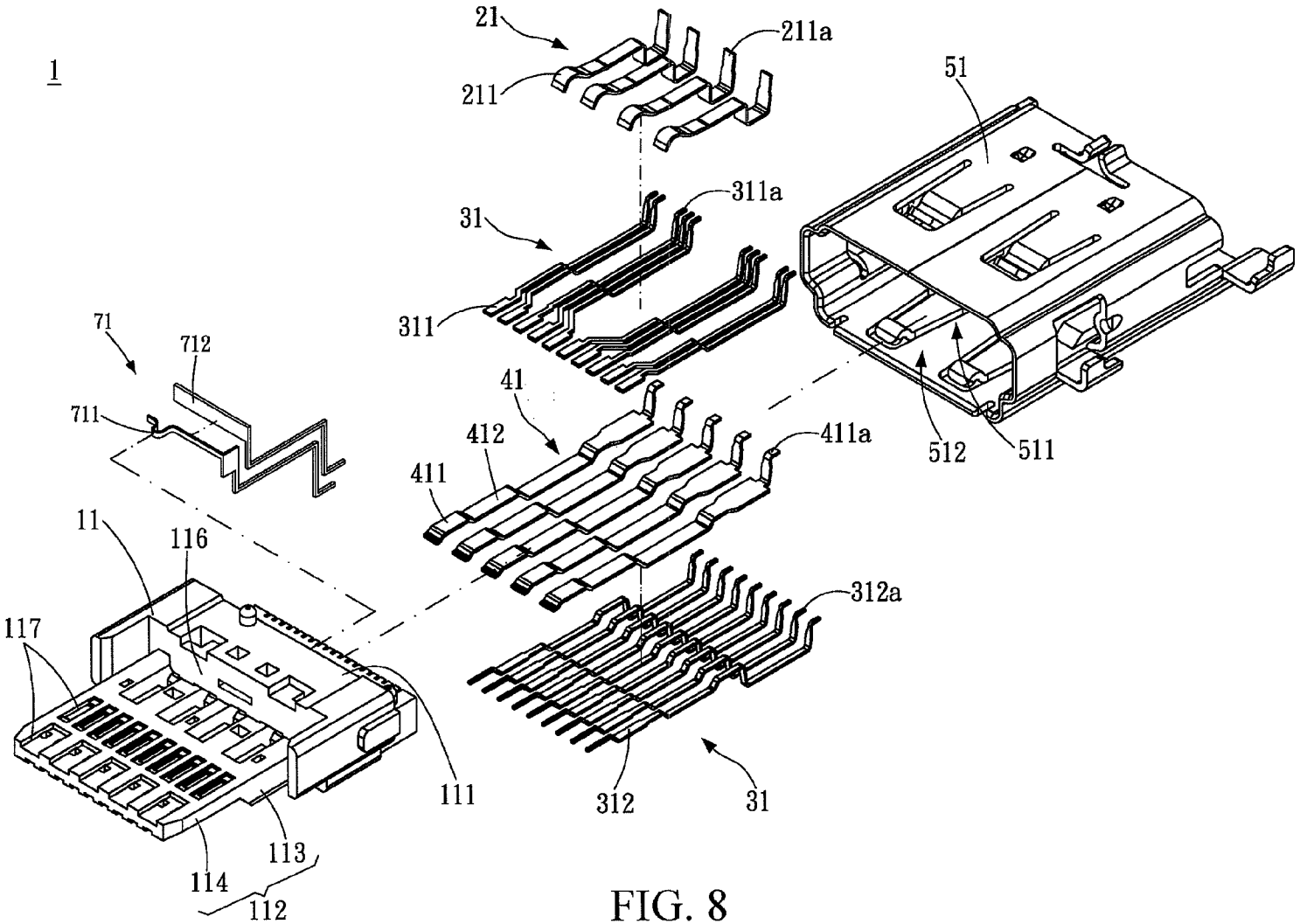
FIG. 8 is a schematic exploded view of a second embodiment of the present invention.

In some embodiments, the electrical connector socket 1 further includes at least one switching terminal 71 (as shown in FIG. 8), and the electrical connector socket 1 further includes a resisting region 116 of a through-perforation type, located on the insulating base 11, and providing setting of the switching terminal 71, where the switching terminal 71 is located on the resisting region 116 of the insulating base 11 and is connected to the plug. In this embodiment, the switching terminal 71 is formed by a swing member 711 and a resisting member 712. Here, one end of the swing member 711 is exposed out of the perforation, and the swing member 711 is pushed by the plug to abut against the resisting member 712 so as to form electrical connection. Here, the above description about the position of the resisting region 116 is only exemplary. In some embodiments, the resisting region 116 may be located at any position of the insulating base 11, for example, on the stop surface 115 (as shown in FIG. 6), or the main body 111 (not shown), as long as corresponding contact and electrical detection are possible in an insertion path of the plug.

In the present invention, a tongue plate of the insulating base includes a first tongue portion and a second tongue portion connected to the first tongue portion, so as to provide setting of a first group of signal terminals, a second group of signal terminals, and a third group of signal terminals, thereby providing an effect of transmitting a plurality of different signals. Each of the second terminals and the fourth terminals has one end located on a first surface of the second tongue portion of the insulating base, and the ends are arranged in front and rear rows. Further, the second terminals are located between the first group of signal terminals and the third group of signal terminals, and a transmitting body of the fourth terminal is located on the insulating base and between the second terminal and the third terminal, so as to provide an impedance matching effect among the terminals.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical connector socket capable of transmitting different signals, comprising:

an outer frame;

an insulating base, comprising a main body and a tongue plate, wherein the tongue plate comprises a first tongue portion and a second tongue portion connected to the first tongue portion, the first tongue portion has a first thickness and is connected to the main body, and the second tongue portion has a second thickness being different from the first thickness;

a first group of signal terminals, located on the main body, wherein the first group of signal terminals comprises a plurality of first terminals for transmitting a first signal, and each of the first terminals has one end located on a first surface of the first tongue portion;

a second group of signal terminals, located in the main body, wherein the second group of signal terminals comprises a plurality of second terminals and a plurality of third terminals, each of the second terminals has one end located on a first surface on a first side of the second tongue portion, each of the third terminals has one end located on a second surface on a second side of the second tongue portion opposite with the first surface, and the second terminals and the third terminals are used for transmitting a second signal; and a third group of signal terminals, located in main body, wherein the second terminals are located between the first group of signal terminals and the third group of signal terminals, the third group of signal terminals comprises a plurality of fourth terminals, each of the fourth terminals has one end located on the first surface of the second tongue portion, the fourth terminals are used for transmitting a third signal, and the first group of signal terminals and the third group of signal terminals are used for transmitting a fourth signal;

wherein the fourth terminal comprises a transmitting body, located in the insulating base and between the second terminal and the third terminal; and wherein a stop surface is formed between the first tongue portion and the second tongue portion of the insulating base.

2. The electrical connector socket capable of transmitting different signals according to claim 1, wherein the second tongue portion of the tongue plate has a length greater than that of the first tongue portion.

3. The electrical connector socket capable of transmitting different signals according to claim 1, the outer frame further comprising a first frame port and a second frame port connected to the first frame port, wherein the first tongue portion and a surface of the second tongue portion form a plane facing the first frame port or the second frame port.

4. The electrical connector socket capable of transmitting different signals according to claim 3, further comprising a plurality of limit blocks, located on an inner side of the outer frame, and for limiting a plug in a position inside the outer frame.

5. The electrical connector socket capable of transmitting different signals according to claim 1, further comprising a resisting region, located on the insulating base and providing setting of a switching terminal.

6. The electrical connector socket capable of transmitting different signals according to claim 1, wherein the first terminals comprise a plurality of first pins, the second terminals comprise a plurality of second pins, the third terminals comprise a plurality of third pins, the fourth terminals comprise a plurality of fourth pins, and the first pins, the second pins, the third pins, and the fourth pins are exposed out of the insulating base.

7. The electrical connector socket capable of transmitting different signals according to claim 1, wherein the tongue plate further comprises a plurality of separators, located on a surface of the second tongue portion, and providing setting of one end of each of the second terminals and one end of each of the fourth terminals.

* * * * *